United States Patent [19]

Yoshida et al.

[11] Patent Number: 5,046,328

[45] Date of Patent: Sep. 10, 1991

[54] REFRIGERATION APPARATUS WITH ARTICLE PRESERVING AND DISPLAYING CHAMBER

[75] Inventors: Akiyoshi Yoshida; Junichi Tosaki; Yuji Wakatuki, all of Toyoake, Japan

[73] Assignee: Hoshizaki Electric Co., Ltd., Toyoake, Japan

[21] Appl. No.: 486,973

[22] Filed: Mar. 1, 1990

[51] Int. Cl.[5] ..... A47F 3/04

[52] U.S. Cl. ..... 62/248; 62/255

[58] Field of Search ..... 62/246, 255, 253, 405, 62/248; 312/116

[56] References Cited

U.S. PATENT DOCUMENTS

| | | | |
|---|---|---|---|
| 1,940,515 | 12/1933 | Sundling et al. | 62/248 X |
| 2,568,268 | 9/1951 | Booth | 62/405 X |
| 2,706,387 | 4/1955 | Swanson | 62/255 X |
| 3,056,274 | 10/1962 | Pouchert | 62/255 X |
| 3,230,732 | 1/1966 | Rutishauser et al. | 62/255 |
| 4,019,339 | 4/1977 | Anderson | 62/255 |

*Primary Examiner*—William E. Tapolcai

*Attorney, Agent, or Firm*—Brooks Haidt Haffner & Delahunty

[57] ABSTRACT

A refrigeration apparatus comprises a machine chamber for containing a compressor, a condenser and others, and a display chamber for accommodating articles to be displayed. The display chamber is constituted by an inner box and an outer box between which a cooling air passage is defined. Defined internally of the machine chamber is a cooler chamber enclosed substantially by a heat insulating material in such a manner as to communicate with the cooling air passage. Disposed within the cooler chamber is a cooling air circulating device and a cooler for causing the cooling air to circulate through the cooling air passage and back to the cooler chamber.

21 Claims, 14 Drawing Sheets

REFRIGERATION APPARATUS WITH ARTICLE PRESERVING AND DISPLAYING CHAMBER

BACKGROUND OF THE INVENTION

1. Field of the Invention

The present invention relates to a refrigeration apparatus such as, for example, a showcase equipped with a refrigeration system and exemplified by a showcase for displaying articles of fish, greens and the like used as raw materials for vinegared rice ball with sliced raw fish (or greens) thereon or therein or so-called "sushi" in Japanese in a "sushi" bar or shop or the like places.

2. Prior Art

As is well known in the art, the refrigeration apparatus of the above type includes a machine chamber for housing therein a compressor and other machinery, and a display chamber in which a cooling pipe and others are disposed, wherein a coolant such as the cooling air fed from the compressor is expanded and forced to flow through the cooling pipe for cooling and preserving the raw materials for "sushi" disposed within the display chamber. Heretofore, various structures of such refrigeration apparatuses have been proposed and actually employed.

However, each of the refrigeration apparatuses known heretofore is generally of such a structure in which the cooling pipe is disposed within the display chamber, wherein the interior space of the display chamber is cooled under the effect of evaporation of the coolant flowing through the cooling pipe, as is disclosed, for example, in Japanese Patent Application Laid-Open No. 37665/1987 (JP-A-62-37665).

Due to the disposition of the cooling pipe within the display chamber among others, the hitherto known refrigeration apparatuses suffer from many problems mentioned below:

(1) The cooling pipe provides obstacle upon placing or taking out articles in or from the display chamber as well as upon cleaning the interior space of the display chamber;

(2) Because of straightforward evaporation of the coolant within the cooling pipe, moisture contained in the atmosphere within the display chamber is forced to condense to thereby form frost on the outer surface of the cooling pipe, resulting in an adverse environment to the articles being displayed by promoting dryness of the atmosphere within the display chamber;

(3) Upon stoppage of operation, the frost is detached from the cooling pipe to drop onto the articles being displayed. Under the circumstance, continuous operation is required, which in turn makes it difficult to adjust the temperature prevailing within the display chamber, not to say of degraded capability for power saving; and (4) Because of difference in temperature between the cooling pipe and the interior space of the display chamber, an air flow due to the natural convection takes place, incurring discoloration in the surfaces of fresh food articles under the influence of the air flow.

SUMMARY OF THE INVENTION

Accordingly, an object of the present invention is to provide a refrigeration apparatus which is essentially free from the various problems such as those (1)~(4) mentioned above.

For achieving the above object, there is provided according to a general aspect of the present invention a refrigeration apparatus comprising a machine chamber which contains therein a compressor, a condenser and other machinery as required, and a display chamber for showing articles to be displayed, wherein the display chamber is constituted by an inner box and an outer box between which a cooling air passage or space is defined. Provided internally of the machine chamber is a cooler chamber which is enclosed by a heat insulating material and which is communicated with the cooling air passage. A coolant circulating apparatus and a cooler are disposed within the cooler chamber for circulating the cooling air or coolant through the cooling air passage and the cooler chamber.

The refrigeration apparatus according to a preferred embodiment of the present invention comprises a box-like machine chamber containing a compressor, a condenser and other machinery as required, and a box-like display chamber for showing articles to be displayed, wherein the machine chamber is not disposed at a side lateral to the display chamber but disposed underneath the latter. The display chamber includes an inner box which is constituted by a bottom plate defining the bottom of the inner box, a pair of upwardly extending side plates connected at lower ends thereof to the bottom plate, a ceiling plate connected to the pair of side plates at the upper ends thereof, and an inner front glass panel having an upper end or edge portion supported by the ceiling plate, a lower end or edge portion supported by the bottom plate and lateral edge portions engaging with the pair of side plates, respectively, and an outer box which is constituted by a heat insulating structure defining the bottom of the outer box, a pair of upwardly extending side frames connected at lower ends thereof to the heat insulating structure, a top frame connected to the pair of side frames at upper ends thereof, and an outer front glass panel having an upper end or edge portion supported by the top frame, a lower end or edge portion supported by the heat insulating structure and lateral edge portions engaging with the pair of the side frames, respectively.

The outer box encloses externally the inner box with a distance therefrom, whereby a cooling air passage is defined between the outer box and the inner box. The heat insulating structure disposed at the bottom of the inner box is partially depressed concavely toward the interior of the machine chamber, whereby the cooler chamber is defined in communication with the cooling air passage. Disposed within the cooler chamber are a coolant circulating apparatus and a cooler for circulating the coolant or cooling air through the coolanting air passage and the cooler chamber.

In the refrigerating apparatus according to the present invention, the cooler through which the coolant flows is not disposed within the display chamber but housed within the cooler chamber disposed at the same side as the machine chamber and is communicated to the cooling air passage defined between the inner box and the outer box. Consequently, when a blower fan constituting the coolant circulating apparatus is operated, the coolant air cooled by the cooler flows only through the cooling air passage defined between the inner box and the outer box, but not through the display chamber.

According to the teachings of the present invention, the articles disposed within the display chamber for display can be cooled without need for disposing the cooler or cooling pipe within the display chamber. By virtue of the absence of the cooling pipe within the display chamber, there is now available an increased space within the display chamber which can be used for displaying an increased number of various articles for a given size of the refrigeration apparatus, while cleaning of the interior of the display chamber can be much facilitated. Further, because the display chamber is no more deprived of moisture by the cooling pipe and thus protected against dryness, the display chamber can be advantageously used for preserving fresh or raw foods. Also, because of the absence of the cooling pipe within the display chamber, operation of the refrigeration apparatus can be stopped at any desired time without involving any undesirable situation such as dropping off of the frost from the cooling pipe, which is also advantageous from the standpoint of the power saving.

Since the whole display chamber is cooled by the coolant circulating through the passage between the inner and outer boxes, it can be uniformly cooled such that difference in temperature distribution throughout the atmosphere within the display chamber can be suppressed to a minimum, resulting in that substantially air flow can take place within the display chamber. Thus, raw fresh foods can be protected against the discoloration of surface and the dryness.

In another preferred embodiment of the present invention, the outer front glass panel constituting a part of the outer box may be implemented in a multi-layer structure with the air of an elevated temperature discharged from the machine chamber being blown onto and over the outer surface of the front glass panel. By virtue of this feature, the phenomenon or problem of the front glass panel becoming clouded or foggy can be eliminated in a satisfactory manner.

In a further preferred embodiment of the present invention, the inner box is constituted by a bottom plate, a pair of side plates, a ceiling plate and an inner front glass panel which are engaged or fitted with one another, while the outer box is constituted by a heat insulating structure, side frames, a top frame and an outer front glass panel which are also engaged or fitted with one another, wherein the machine chamber is disposed below the display chamber with a part of the heat insulating structure being depressed to form the cooler chamber. Owing to this feature, the refrigerating apparatus can be implemented in a much simplified structure, which in turn allows the refrigeration apparatus to be assembled or disassembled in a much facilitated manner.

BRIEF DESCRIPTION OF THE DRAWINGS

A more detailed understanding of the invention may be had from the following description of preferred embodiments thereof, given by way of example only and to be read and understood in conjunction with the accompanying drawings, in which.

DETAILED DESCRIPTION OF THE PREFERRED EMBODIMENTS

Now, the present invention will be described in detail in conjunction with preferred or exemplary embodiments thereof by reference to the accompanying drawings in which like reference symbols or numerals denote like or equivalent parts throughout various figures. Further, the following description will be made on the assumption that the present invention is applied to a showcase such as those used for displaying a variety of fish articles or raw materials for vinegard rice ball with sliced raw fish or the like thereon or therein or so-called "sushi" in Japanese (hereinafter referenced as "sushi") in a "sushi" bar or shops or like places. However, this is only for the purpose of description and it will be readily understood by those skilled in the art that the present invention is not limited to such "sushi" showcase but can equally be applied to a variety of showcases for displaying and/or preserving other materials or articles.

Figure 1A:
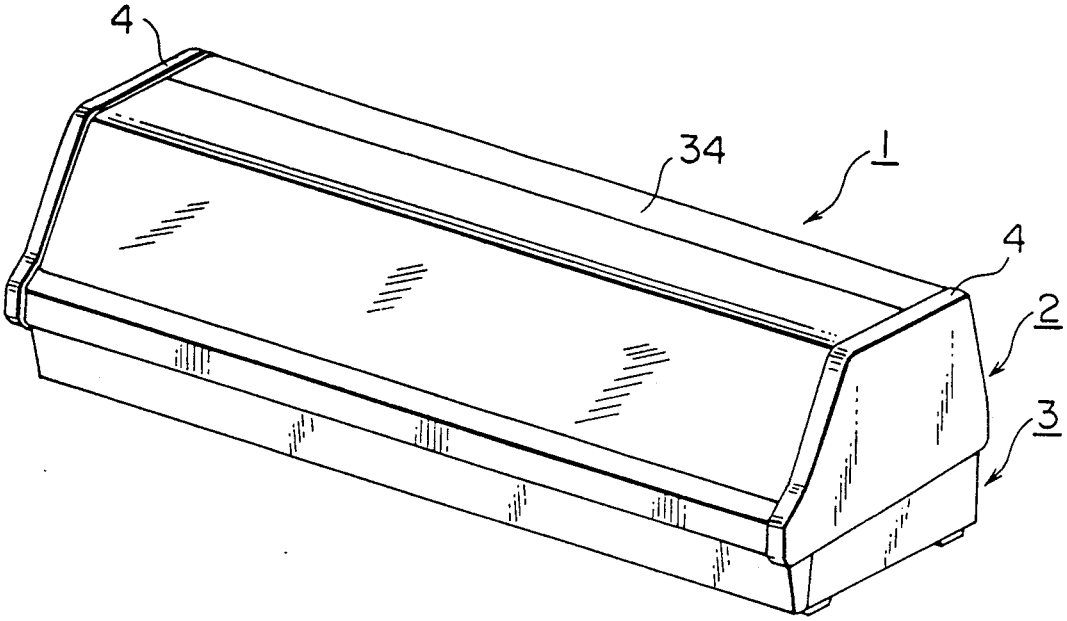
FIG. 1A is a front perspective view of a refrigeration apparatus according to a preferred embodiment of the present invention.

FIG. 1A is a perspective view showing schematically and generally a showcase (refrigeration apparatus) 1 for displaying fish or the like raw materials for "sushi". The showcase 1 includes a display chamber 2, a machine chamber 3 which is disposed beneath the display chamber 2, side covers 4 disposed at both sides of the display chamber 2, respectively, and a top cover 34 disposed so as to define the top of the display chamber 2 and adapted to fittingly engage with the side covers 4. Thus, it can be noted that the display chamber 2 extends substantially over the whole length of the showcase 1 between both the sides or lateral ends thereof. When this showcase is to be installed on a counter or bar (not shown) in a "sushi" shop, the showcase being so directed that the front side of the showcase as viewed in FIG. 1A faces toward customers with the back or rear side of the showcase 1 shown in FIG. 1B facing toward the user or "sushi" artisan.

Figure 1B:
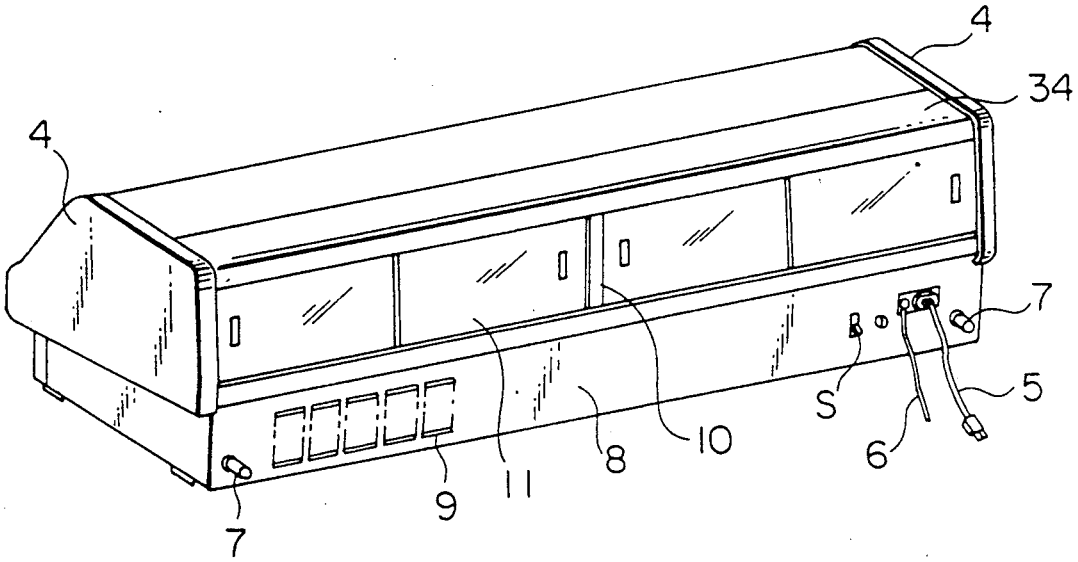
FIG. 1B is a rear perspective view of the refrigeration apparatus shown in FIG. 1A.

As seen in FIG. 1B, there are provided on the rear side of the showcase 1 an electric power supply cord 5 connected to the machine chamber 3, a wire 6 for grounding the refrigeration apparatus to the earth, a drainage pipe 7, a rear cover 8, vents 9, a center frame 10, sliding doors 11, a power on/off switch S and others. A transparent front glass sheet or panel of a duplicated structure is disposed on the side facing the customers, as will be described hereinafter.

Figure 3:
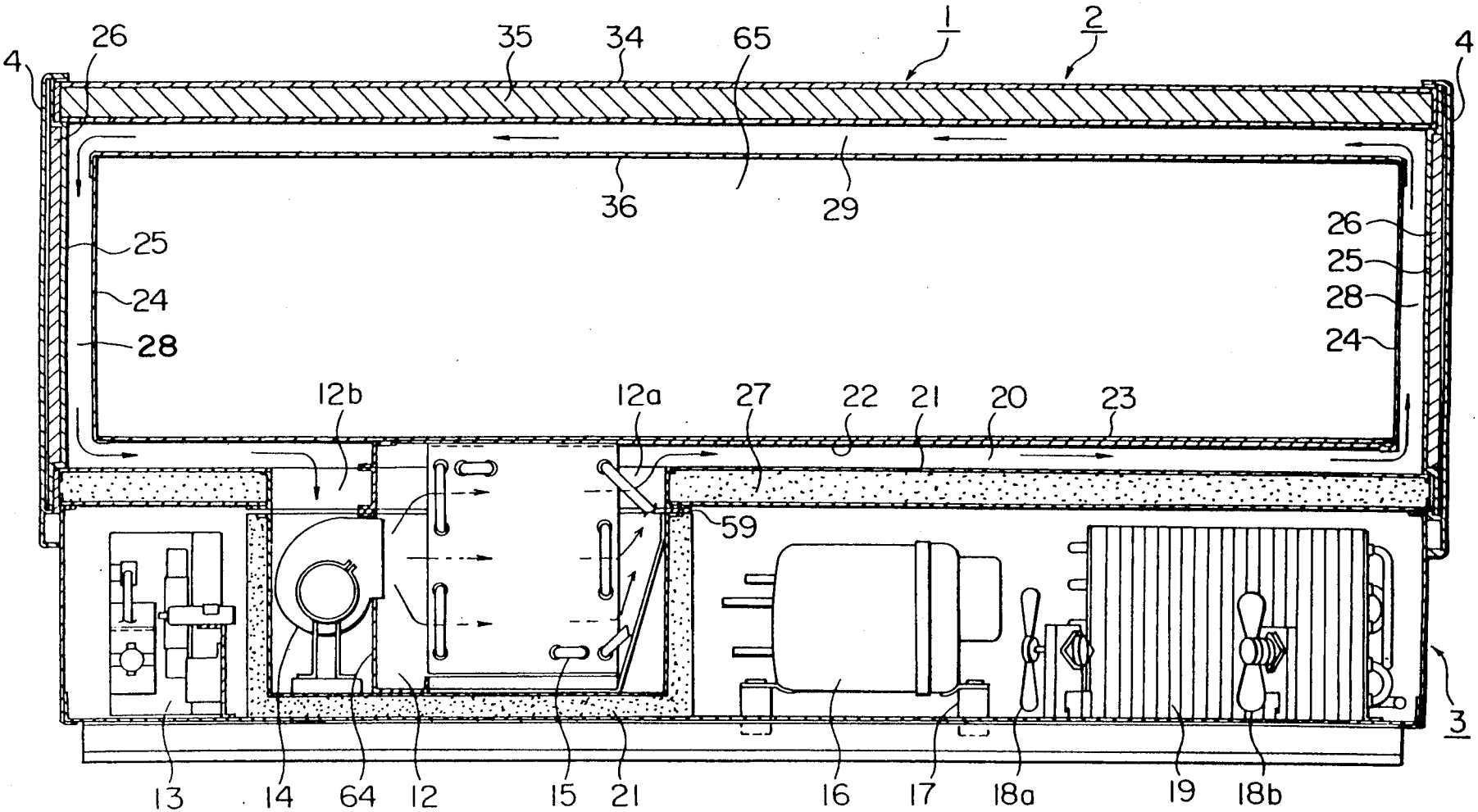
FIG. 3 is a view showing a longitudinal vertical section of the refrigeration apparatus shown in FIG. 1.
Figure 4:
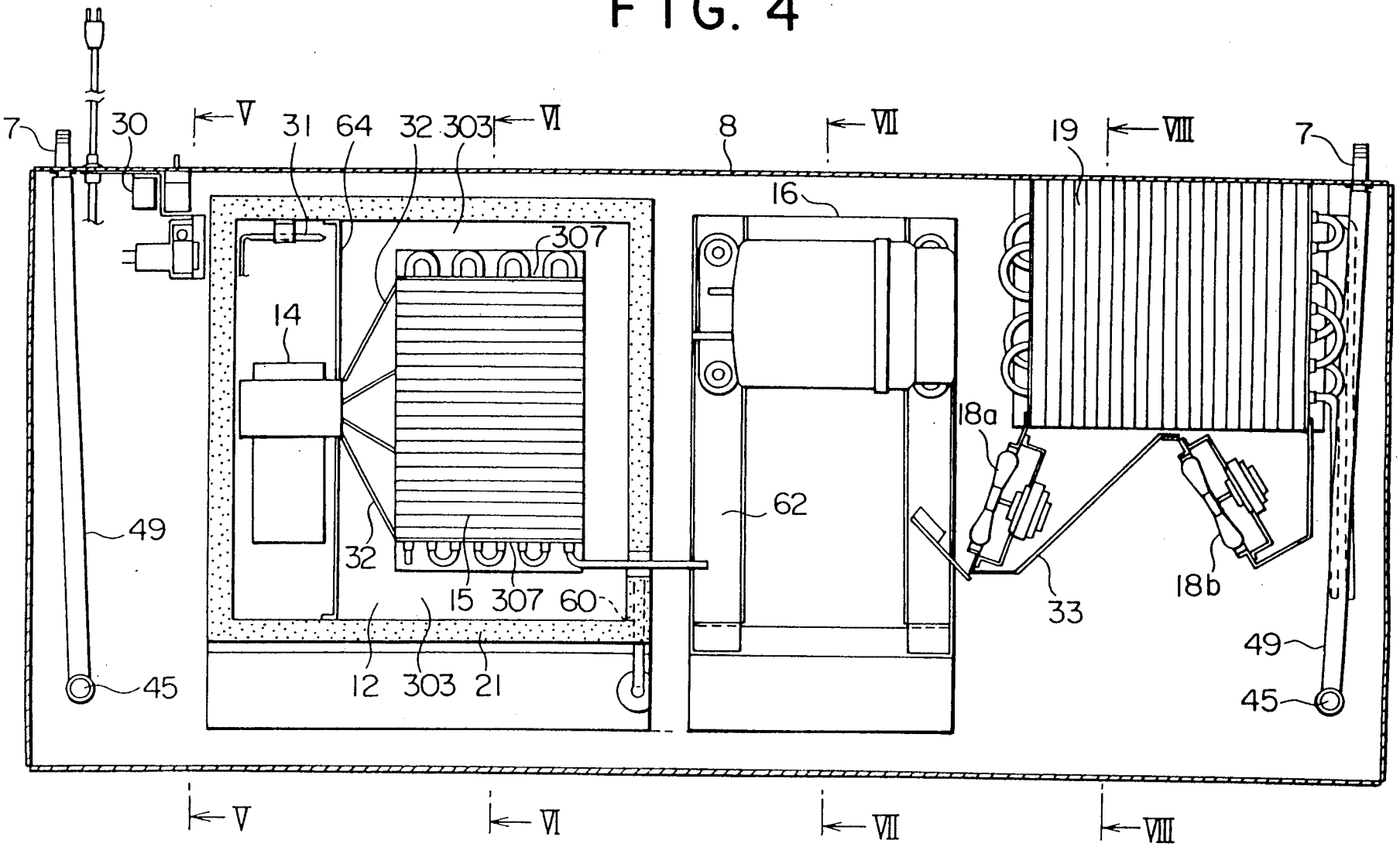
FIG. 4 is a horizontal sectional view showing a longitudinal section of a machine chamber of the refrigerating apparatus shown in FIG. 1.

FIGS. 3 and 4 are sectional views showing the showcase 1 shown in FIGS. 1A and 1B in vertical section taken along a longitudinal axis and in horizontal section, respectively. As can be seen from these figures, disposed in the machine chamber 3, which encloses therein a cooler chamber 12 defined by a heat insulating structure 21 formed of a suitable heat insulating material are a panel 13 for electrical equipment, a blower fan (a coolant circulator) 14, a cooler 15, a compressor 16 which is preferably supported on legs 17 of rubber, condenser fans 18*a* and 18*b*, a condenser 19, a duct defining plate 33 and others. The cooler 15, the compressor 16 and the condenser 19 are interconnected together by a refrigeration pipe line (not shown) to constitute a refrigeration system.

The cooler chamber 12 is partitioned into a blower fan space and a cooler space by a partition wall 64. In the cooler space, a plurality of air directing plates 32 are disposed in a radial pattern in the vicinity of a discharge port of the blower fan 14 for the purpose of directing properly the air flow generated by the flow fan 14 toward the cooler 15. In FIG. 4, a reference numeral 30 denotes a thermostat and a numeral 31 denotes a temperature sensor part thereof.

Figure 5:
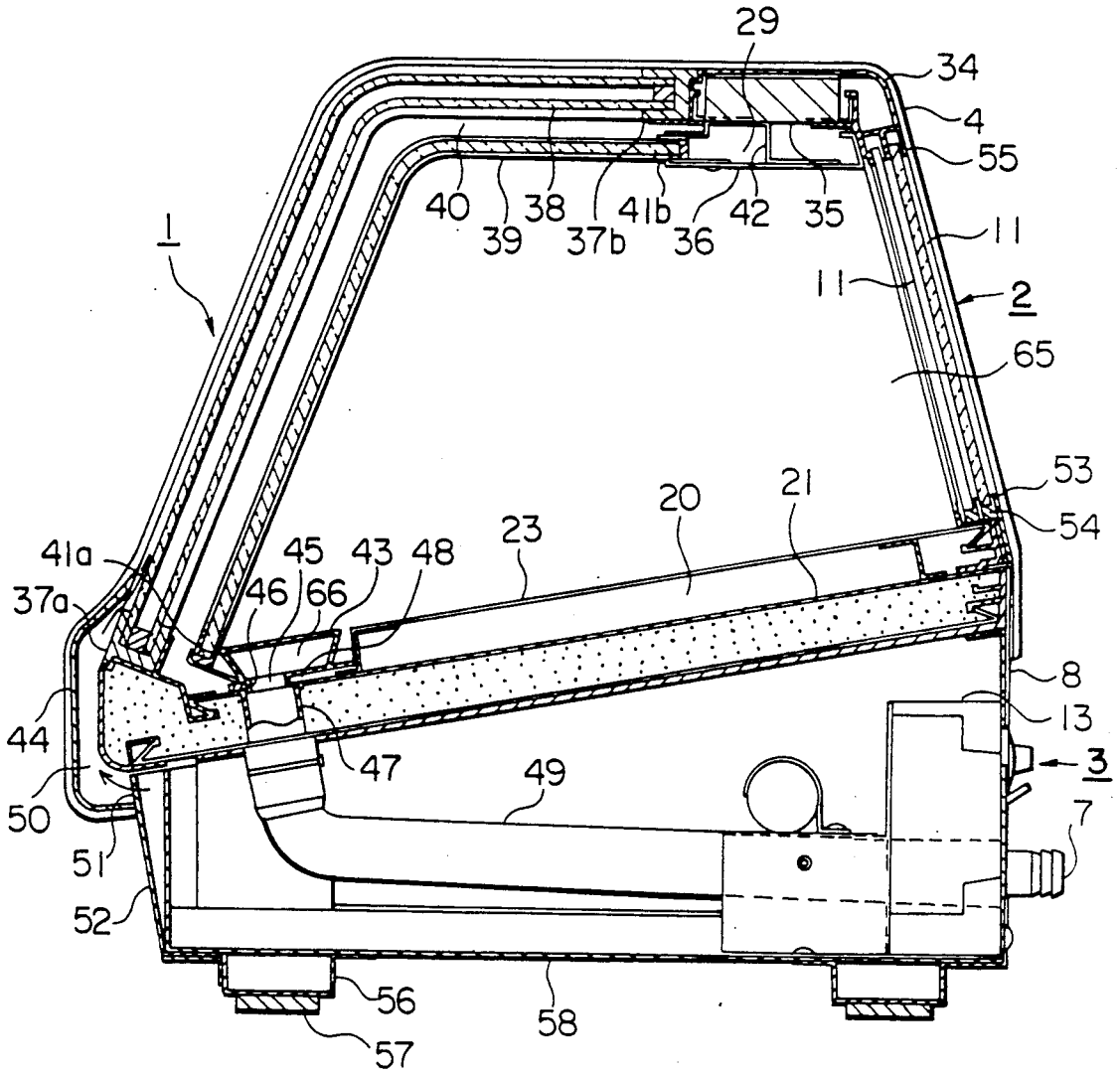
FIGS. 5, 6, 7 and 8 are sectional views taken along the lines V—V, VI—VI, VII—VII and VIII—VIII in FIG. 4, respectively.

The display chamber 2 defining a display space 65 within the showcase 1 is composed of an inner box and an outer box, between which there are formed coolant passages 20, 28, 29 and 40. Formed in the above-mentioned cooler chamber 12 at an upper portion thereof are openings 12*a* and 12*b* communicated with the ends of the coolant passages 20 and 28 respectively. The cooling air or coolant fed under a pressure by the blower fan 14 as indicated by an arrow in FIG. 3 leaves the cooler chamber 12 through the above-mentioned opening 12*a* and passes through the coolant passages 20, 28, 29 and 40 to flow again into the cooler chamber 12 through the opening 12*b*. The passage 40 is shown in FIG. 5 and in communication with the passage 29. Although it appears from FIG. 5 as if the coolant passages 29 and 40 were disconnected from each other by a stationary member 42, it should be understood that the stationary member 42 does not extend along the whole length of the showcase 1 but is constituted by shorter lengths of pieces distanced from one another to thereby allow the coolant passages 29 and 40 to fluidly communicate with each other. Also, it should be noted that the cooling air passage 40 is communicated to the passages 28, although not shown.

Figure 2:
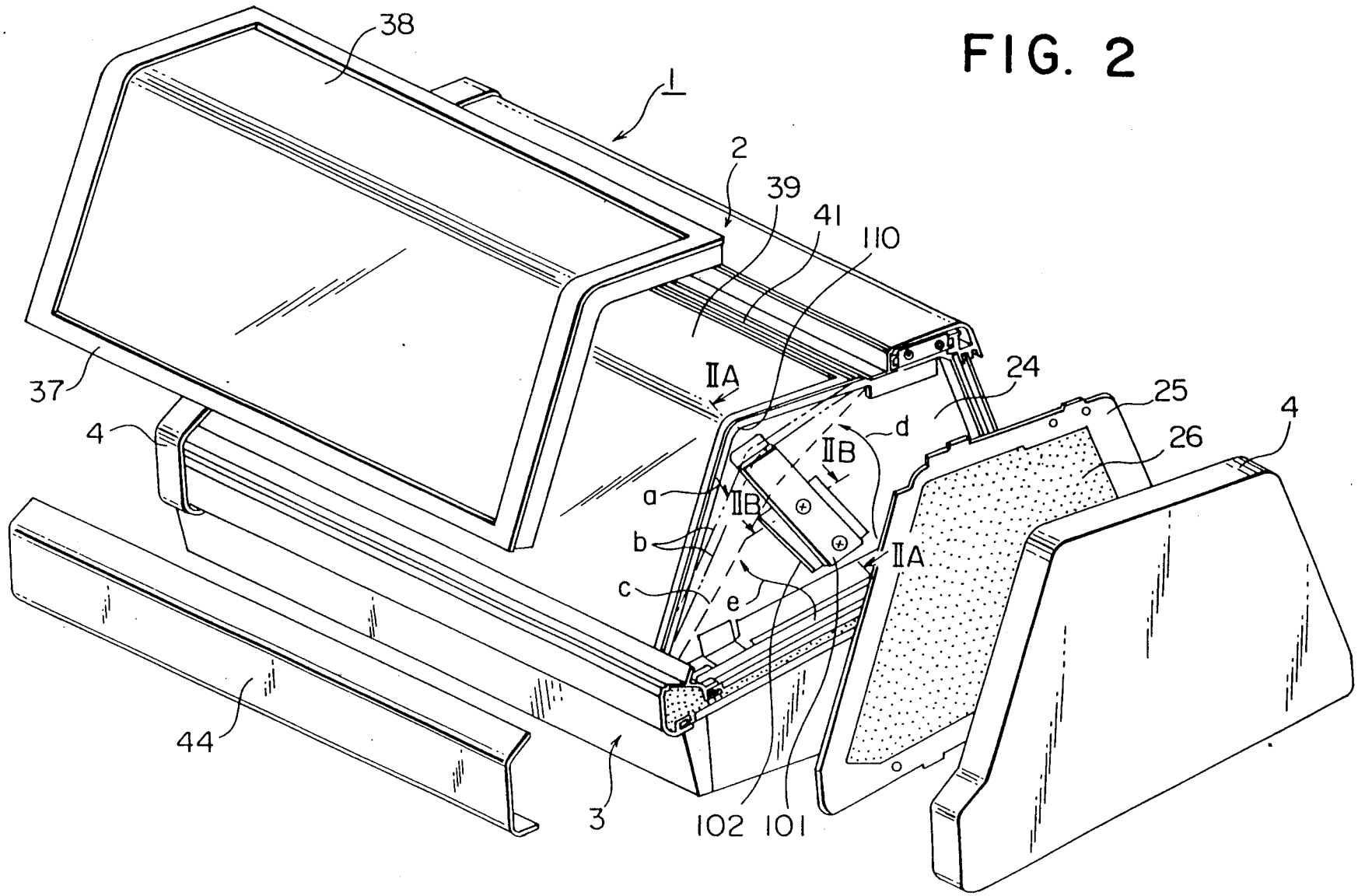
FIG. 2 is a perspective view showing, in an exploded state, side frames, front glass panels and others of the refrigerating apparatus shown in FIGS. 1A and 1B.

The inner box defining the display chamber 2 is composed of a bottom plate 23 disposed at the bottom, a pair of vertically upwardly extending side plates 24 having lower ends connected to the bottom plate 23, a ceiling plate 36 connected to the pair of the side plates 24 at the top ends thereof, and an inner front glass panel 39 (FIG. 5) having a top end supported by the ceiling plate 36, a bottom end supported by the bottom plate 23 and left and right ends or edge portions engaging with the paired side plates 24, respectively, (see FIG. 5). On the other hand, the outer box of the display chamber 2 is constituted by a heat insulating structure 21 positioned at the bottom, a pair of vertically upwardly extending side frames 25 connected at lower ends thereof to the heat insulating structure 21, a top frame 35 connected to the paired side frames 25 at the top ends thereof, and an outer front glass panel 38 having an upper or top end supported by the top frame 35, a bottom or lower end supported by the heat insulating structure 21, and left and right ends or edge portions engaging with the paired side frames 25, respectively, (see FIG. 5). The outer front glass panel 38 is of a multi-layer structure as shown. Incidentally, it should be mentioned that the spaces each defined between the side cover 4 and the side frame 25, respectively, are filled with a heat insulating material 26 and that an appropriate heat insulating member 22 is affixed to the rear surface of the bottom plate 23 in a zone extending from the top of the cooler chamber 12 to the cooling air passage 28, as seen in FIGS. 2 and 3.

The fan unit for the condenser mentioned hereinbefore is not constituted by a single fan of a larger diameter but by a pair of fans 18*a* and 18*b* each of a smaller diameter so that the height of the machine chamber 3 can be reduced. Further, by employing the pair of the fans 18*a* and 18*b*, the area of the condenser 19 to be cooled through suction of the air is shared between these fans 18*a* and 18*b*. Accordingly, the combination of the smaller diameter fans 18*a* and 18*b* will never give rise to a degradation in the heat exchange efficiency of the condenser 19. The fan 18*a* has an air discharge outlet directed toward the compressor 16, while the air discharge port of the fan 18*b* is directed toward the front side of the machine chamber 3, i.e. facing toward the customer, so that the air having a temperature elevated as the result of utilization thereof for cooling the condenser 19 is forced to flow in the direction toward a front cover 52 of the machine chamber 3 (see FIG. 5). The front cover 52 is provided with an opening 51 through which the hot air (i.e. air having an elevated temperature) flows into and through a passage 50 defined by an air guide 44 in the direction indicated by an arrow in FIG. 5 and then flows along the exterior surface of the outer front glass panel 38 to prevent the surface of the front glass panel 38 facing the customer from becoming dim or foggy.

As best shown in FIG. 5, which is a sectional view taken along the line V—V of FIG. 4, a pair of legs 56 project in parallel with each other from the bottom plate 58 of the machine chamber 3 and serve to support the showcase 1 on the counter or bar through pads 57 preferably formed of rubber. Further, the bottom heat insulating structure 21 including a heat insulating material 27 and defining the outer box of the display chamber 2 is inclined upwardly from the left-hand side to the right-hand side as viewed in FIG. 5, as a result of which the space defined within the machine chamber 3 has a greater height on the side facing toward the user or artisan (right-hand side as viewed in FIG. 5) than the side facing toward the customer. In this manner, the machine chamber 3 is implemented with sufficient dimensions for accommodating therein the machines such as the cooler 15, the compressor 16, the condenser 19 and other machinery as required which occupy a relatively large space, wherein the machines mentioned above are installed within the machine chamber, being offset toward the side facing the user or "sushi" artisan (i.e. toward the upper side as viewed in FIG. 4).

As appreciated from the above description, in the preferred embodiment of the present invention, the display chamber 2 is disposed above the machine chamber 3 and extends substantially along the whole length of the refrigeration apparatus, while the machine chamber 3 is so defined as to provide a sufficient space for accommodating the compressor 16, the condenser 19 and others by providing the ceiling portion or heat insulating structure 21 with an inclination in the upward direction from the front cover side to the rear cover side of the machine chamber 3. By virtue of such structure, the space available on the counter or bar can be utilized effectively for displaying articles such as raw fish materials for "sushi" without being occupied by the machine chamber 3. When a plurality of showcases each having the structure as described above are to be disposed in juxtaposition, the transparent display chambers of the showcases are arranged substantially in line consecutively, whereby the effect of attracting the attention of the customers to the articles being displayed can be significantly enhanced. Also, it should be added that the overall height of the refrigeration apparatus is not increased to any appreciable extent even by stacking the machine chamber 3 and the display chamber 2 on each other.

Because of the inclined disposition of the heat insulating structure 21 as described above, the bottom plate 23 of the display chamber 2 overlying the heat insulating structure 21 is also disposed in a similar inclined state with a predetermined distance therebetween for defining the passage 20 as previously mentioned. The heat insulating structure 21 extends to or near to the bottom ends of the outer front glass panel 38 and the inner front glass panel 39. The bottom plate 23 is bent toward the heat insulating structure 21 at a position reaching short of the abovementioned bottom end to thereby form a groove 66 extending lengthwise of the showcase 1. Removably disposed on the groove 66 is a cover plate 43 substantially flush with the top surface of the bottom plate 23. It is a conventional practice to dispose a draining board or so-called "ginsu" in Japanese on the bottom plate 23 and the cover plate 43 and to place thereon the raw fish materials for "sushi" for display.

As will be readily appreciated, the inclined disposition of the bottom plate 23 and the cover plate 43 for supporting thereon the articles such as, for example, raw fish materials and/or greens or the like directly or indirectly as described above is advantageous in that the articles disposed innermost within the display chamber 2 on the cover plate 43 as well as the bottom plate 23 as viewed by the front side (i.e. viewed from the customer) can be seen at the highest position. In other words, the customer can command the whole view of the interior of the display chamber 2. Further, the user or "sushi" artisan also can easily survey the whole interior of the display chamber 2 from the rear side of the showcase without the articles located innermost being disturbed by rails receiving the top ends of the sliding doors 11. Also, the user who works ordinarily in the standing-up posture easily obtain access to the articles being displayed by stretching his or her hand along the inclined bottom plate 23 and the cover plate 43 after opening the sliding door 11.

Formed in the bottom plate 23 and the heat insulating structure 21 at appropriate locations (two locations in the embodiment as seen in FIG. 4) are drain holes 45 each communicating with the groove 66 through a seal member 48, on one hand, and connected to a drain hose 49 through a connecting pipe 47, on the other hand, the drain hose 49 in turn being communicated to a drain pipe 7. Each of the seal members 48 has an opening formed therein in which an annular inner flange 46 formed in the bottom plate 23 around the drain hole 45 is fittingly engaged to thereby hold the seal member 48 in place. Although the drain holes 45 are ordinarily maintained in the closed state by appropriate cover members (not shown) during the use of the refrigeration apparatus, they can be opened upon cleaning of the refrigeration apparatus. In the state in which the drain holes 45 are closed by the cover members, water can be collected within the concaved groove 66.

By forming the concaved groove 66 extending lengthwise of the refrigeration apparatus together with the drain openings 45 at an intermediate portion of the bottom plate 23 inclining downwardly from the rear side of the display chamber 2 toward the front side, as described hereinbefore, the water used for cleaning can be easily drained without involving adhesion to the inner walls of the display chamber 2 in the form of waterdrops. Further, by collecting and reserving the water within the groove 66 by closing the drain holes 45 during the use of the refrigeration apparatus, perishable or fresh vegetables such as parsley, celery, cucumbers and the like greens placed thereon can be protected against being dried and kept fresh for an elongated period. Further, by fitting the cover plate 43 in the groove 66 substantially flush with the top surface of the remaining portion of the bottom plate 23, the space located above the groove 66 can be advantageously utilized for displaying articles.

Because the lower end or edge portion of the front glass panel 39 is supported within the groove 66, the bottom edge portion is lowered substantially by the depth of the groove 66, whereby the see-through area of the transparent front glass panel 39 is enlarged correspondingly. Thus, the dead ground space which would otherwise exist in the vicinity of the bottom edge portion of the front glass panel can be substantially eliminated. Thus, there is provided a refrigeration apparatus which can enjoy an improved visibility of the articles being displayed within the display chamber.

Further referring to FIG. 5, there are provided at a longitudinal end portion of the top cover 34 a pair of rail members 55 for receiving the upper end portions of the sliding doors 11, while a pair of rail members 53 are provided at the top end portion of the rear cover 8 for the machine chamber 3 for receiving the lower edge portions of the sliding doors 11 through sliders 54, whereby the sliding doors 11 can be opened or closed along the rail members 53 and 55 to the left or right (in the direction orthogonal to the plane of the drawing in the case of FIG. 5). The rail member 53 is stably supported on the upper end portion of the bottom plate 23. The lower end portion of the bottom plate 23 is bent in a substantially L shape and supports the lower edge portion of the inner front glass panel 39 through an interposed packing 41*a*, while the upper end portion of the inner front glass panel 39 is supported by the ceiling plate 36 and the fixing member 42 thereof through a packing 41*b*. On the other hand, the lower end portion of the outer front glass panel 38 is supported at the lower end portion of the heat insulating structure 21 through a packing 37*a* while the upper end portion of the outer front glass panel 38 is supported at the other longitudinal edge portion of the top cover 34 through a packing 37*b*. As can be seen in FIG. 2, the packings 41*a*; 41*b* and 37*a*; 37*b* may be constituted by integral ring-like packings 41 and 37, respectively.

Figure 6:
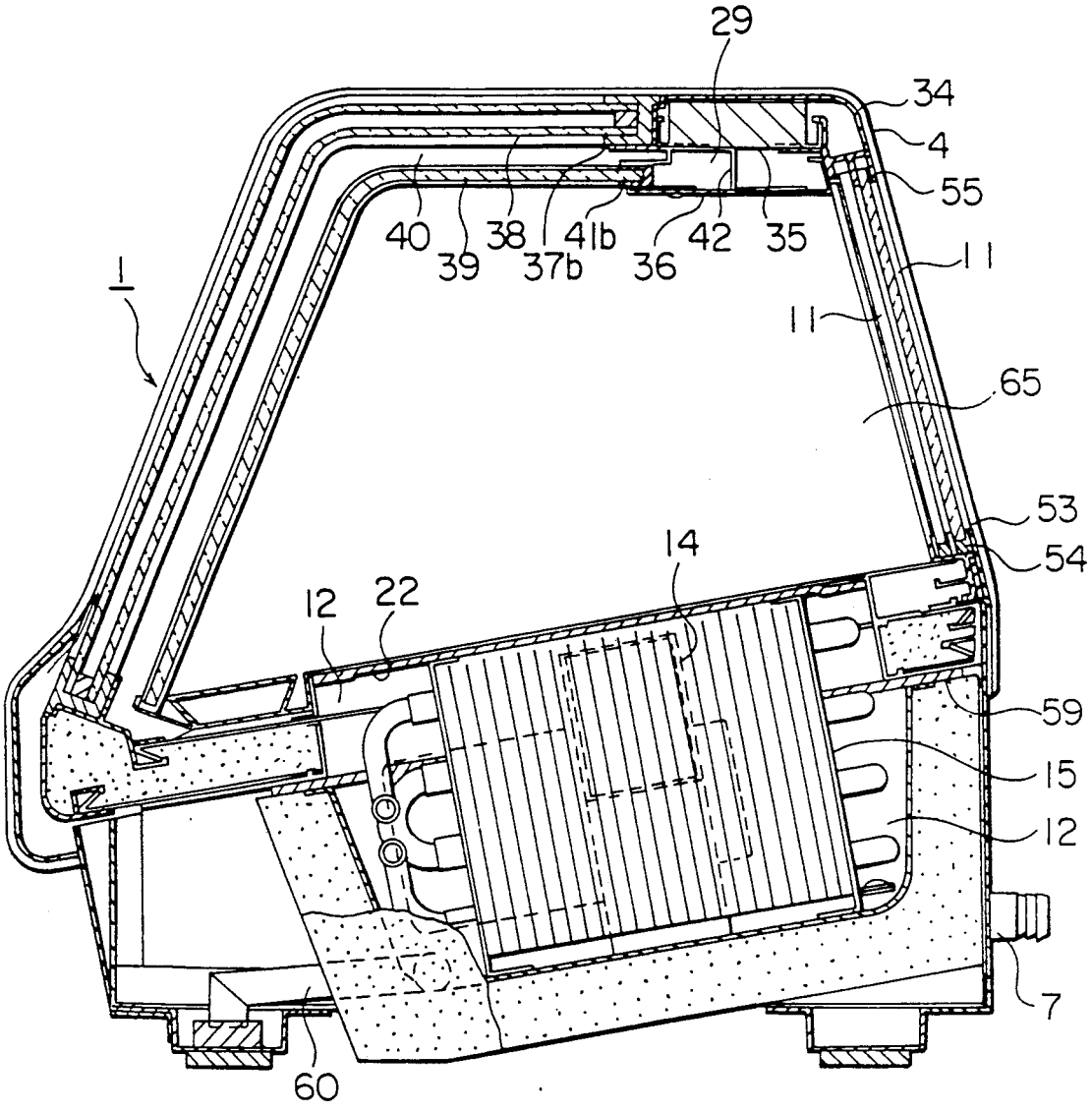
Figure 7:
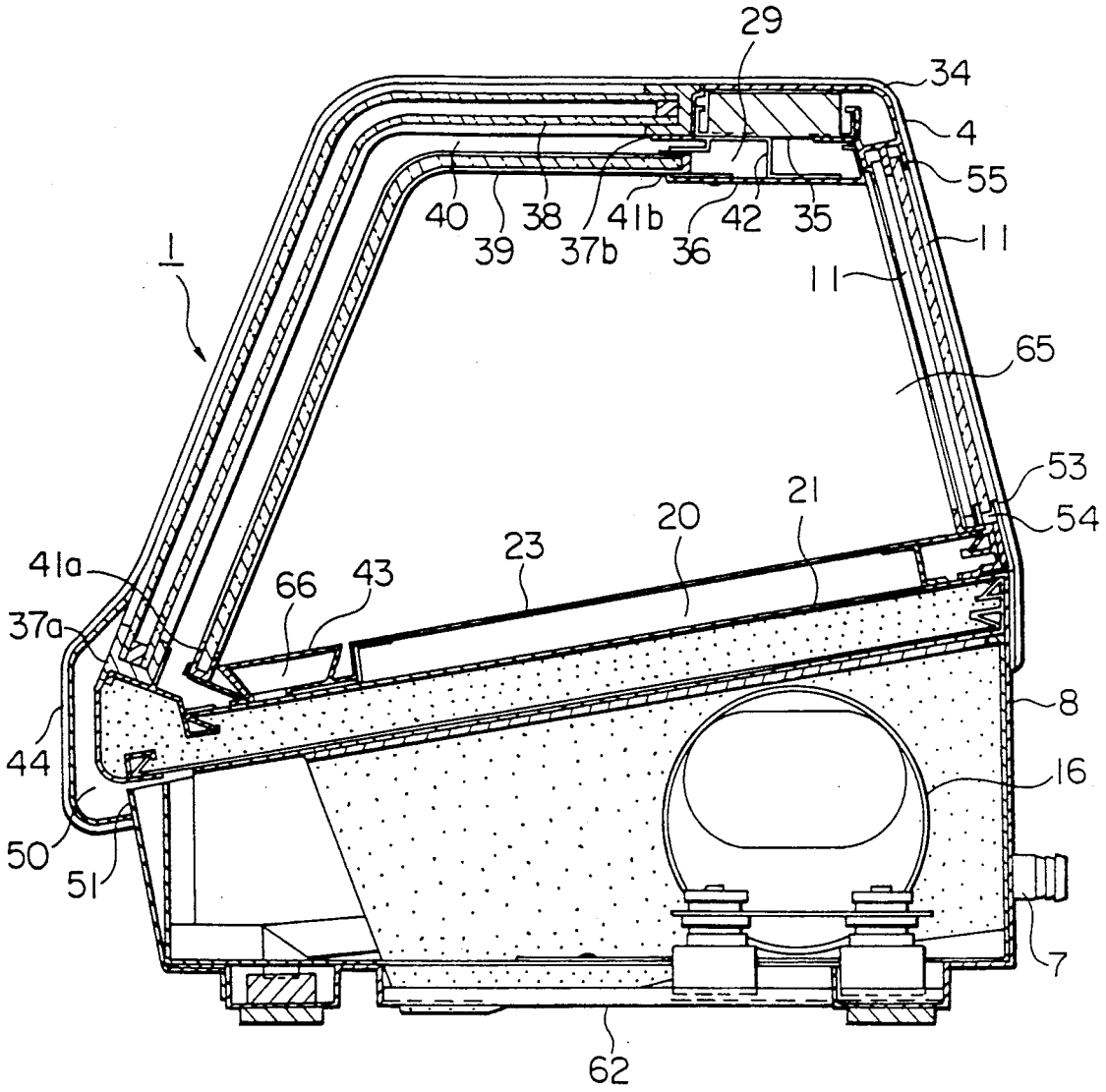
Figure 8:
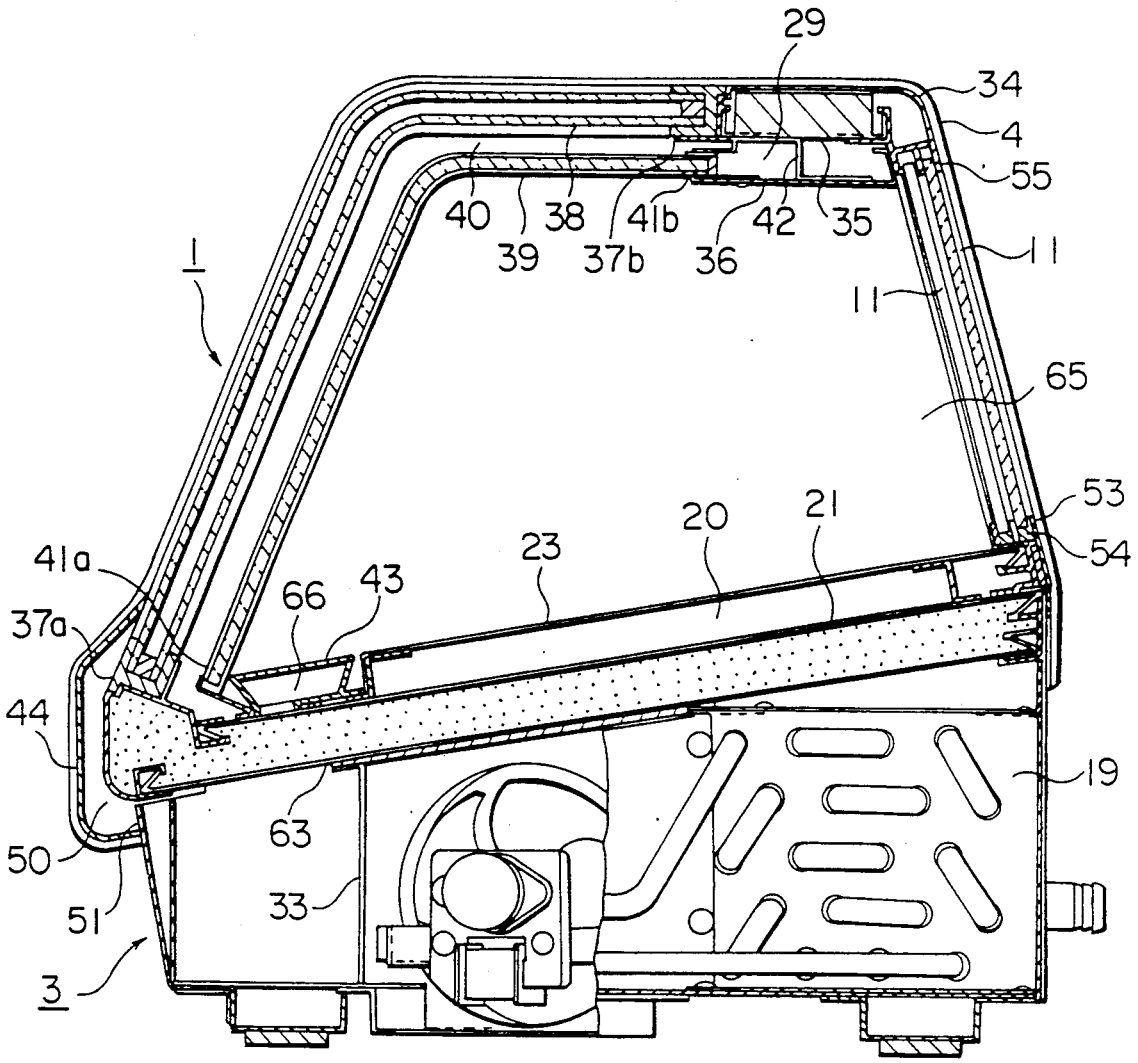
Figure 9:
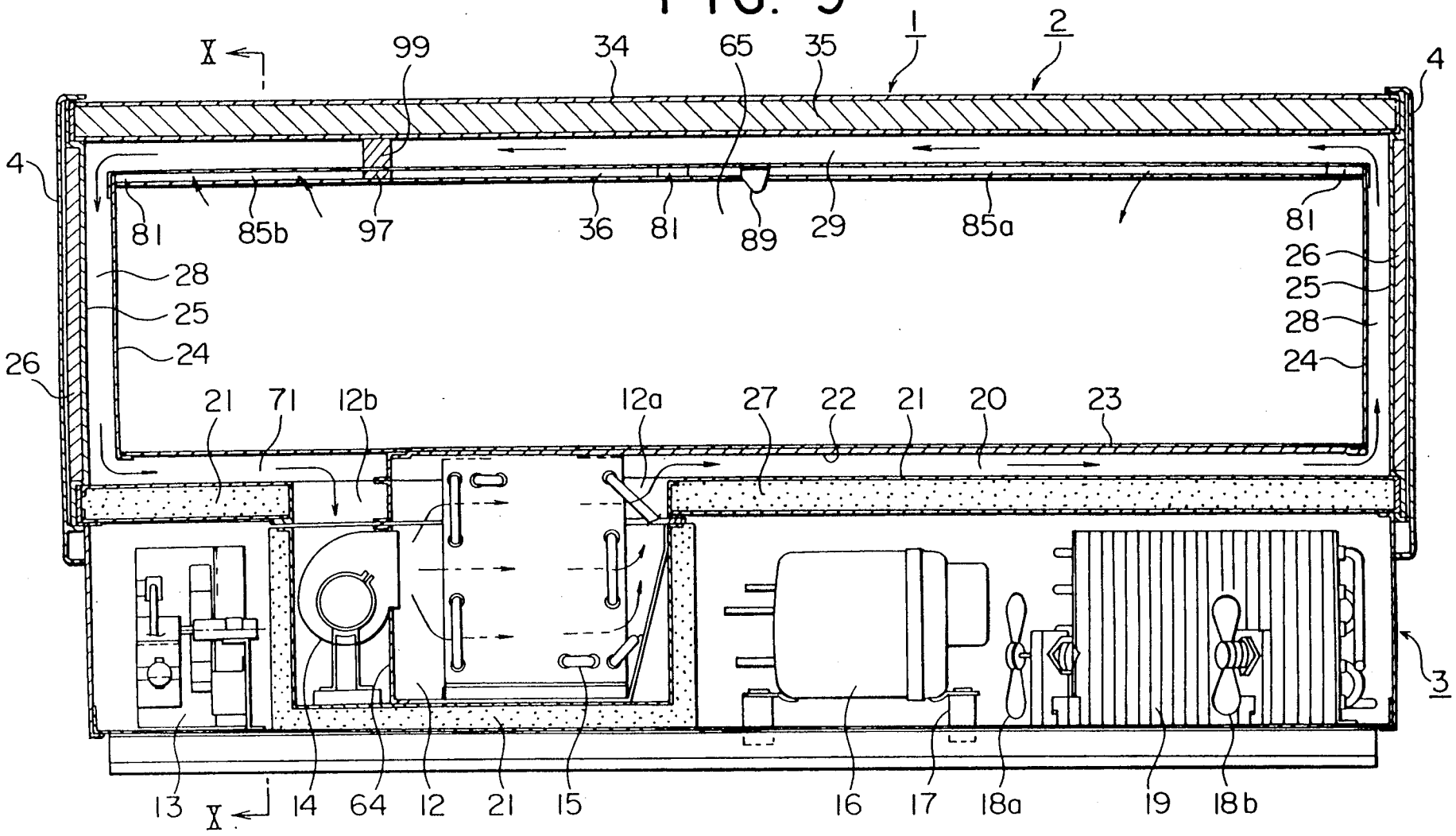
FIG. 9 is a sectional view similar to FIG. 3 and shows a modified embodiment of the refrigeration apparatus according to the present invention.

Referring to FIGS. 3 and 6, a reference numeral 59 denotes a seal member for hermetically sealing the cooler chamber 12. Further, in FIGS. 4 and 6, a reference numeral 60 denotes a drain pipe for draining water from the cooler chamber 12. In FIGS. 4 and 7, a reference numeral 62 denotes a mounting plate for mounting the compressor 16. In FIG. 8, a reference numeral 63 denotes a seal member. Since disposition of the members mentioned above can be understood from the illustrations in the figures, detailed description thereof will be unnecessary.

Upon assembly of the refrigeration apparatus 1 having the above structure, it is necessary to dispose the inner front glass panel 39 between the side plates 24 mounted previously on the main body of the refrigeration apparatus before the outer front glass panel 38, the side frame 25, the insulating material 26 and the side cover 4 shown in FIG. 2 in the exploded state can be mounted in this order or sequence.

The front glass panel 39 is enclosed by the packing 41 because the former must be hermetically disposed or sandwiched between the left and right side plates 24, as described hereinbefore. Accordingly, in the free state before being mounted, the longitudinal dimension of the front glass panel 39 fitted with the packing 41 is longer than the distance between the side plates 24. Consequently, upon assembly of the front glass panel 39, particularly the upper left end portion of the side plate 24 must be expanded outwardly to a position indicated by a single-dotted broken line b in the direction indicated by an arrow a in FIG. 2, in order that no obstacle is encountered upon disposing of the front glass panel 39 fitted with the packing 41. At that time, the side plate 24 is elastically bent outwardly substantially along a position indicated by a broken line c.

Such being the circumstances, a side plate having a high rigidity makes it difficult to bend it, while excessively low rigidity will lower the mechanical strength of a side plate, reducing the reliability of the seal realized by the packing 41.

Figure 2A:
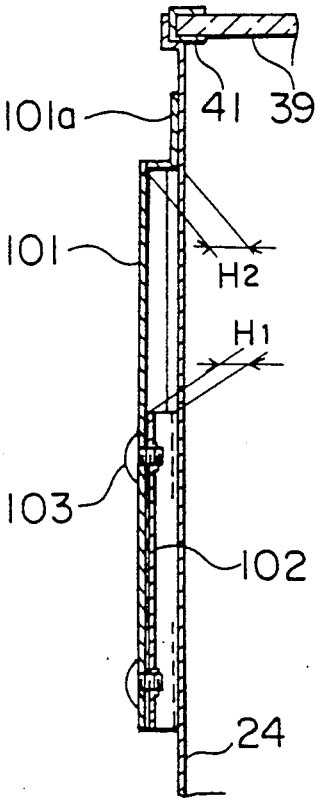
FIG. 2A is a sectional view taken along the line A—A in FIG. 2.
Figure 2B:
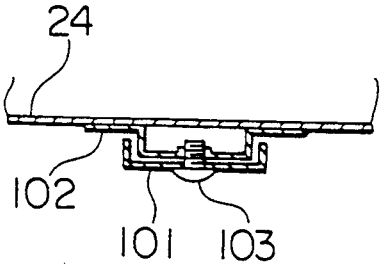
FIG. 2B is a sectional view taken along the line B—B in FIG. 2.

Accordingly, in a preferred embodiment of the present invention, a mounting plate 102 is fixedly secured by suitable means such as an adhesive or bonding agent to the external surface of the side plate 24 at a position located below the aforementioned line c and additionally a reinforcing member 101 is secured onto the mounting plate 102 by means of screws 103, as can be seen in FIGS. 2, 2A and 2B. The reinforcing member 101 as well as the mounting plate 102 is so disposed that the upper ends thereof orient toward a rounded corner 110 of the front glass panel 39.

Upon assembly of the refrigeration apparatus 1, the screws 103 for securing the reinforcing member 101 are loosened or removed, and then the upper left portion of the side plate 24 is bent, as described hereinbefore, whereon the front glass panel 39 is accommodated between the side plates 24. The mounting plate 102 is constituted by a channel member having a substantially inverted C-like section and a height $H_1$, while the reinforcing member 101 is constituted by a channel member of a substantially inverted C-like section and has a height $H_2$ which is greater than the height $H_1$. By tightening the screws 103, the side plate 24 is pulled toward the reinforcing member 101 by way of the interposed mounting plate 102, whereby the packing 41 of the front glass panel 39 can be tightly press-fitted under the reaction force. Subsequently, the outer front glass panel 38 is positioned in place, whereon the side frame 25, the heat insulating material 26 and the side cover 4 are sequentially assembled in this order to complete the assembly of the refrigeration apparatus 1.

The reinforcing member 101 provided in the manner described above is positioned within the passage 28, as a result of which the cooling air flowing into the passage 28 from the passage 20 is divided into two streams, as indicated by arrows d and e in FIG. 2, and then flows into the passage 29. In this connection, it is noted that because of the orientation of the upper end of the reinforcing member 101 toward the rounded corner 110 of the front glass panel 39, it is difficult for the cooling air to reach the rounded corner 110.

In the embodiment, the reinforcing member 101 is secured onto the mounting plate 102 by using the screws. However, the use of the mounting plate 102 may be omitted by securing the reinforcing member 101 directly onto the side plate 24 by using an adhesive or the like after the front glass panel 39 has been fitted. In that case, it is preferred that the tip end portion 101*a* of the reinforcing member 101 is positioned in the vicinity of the rounded corner 110 of the front glass panel 39.

By constructing the inner box with the bottom plate 23, the pair of side plates 24, the ceiling plate 36 and the inner front glass panel 39 which engage or fit with one another while constructing the outer box with the heat insulating structure 21, the side frames 25, the top frame 35 and the outer front glass panel 38 which engage or fit with one another and disposing the machine chamber or compartment 3 beneath the display chamber 2, with a part of the heat insulating structure 21 being concaved toward the machine chamber 3 to thereby form the cooler chamber (compartment), the refrigeration apparatus of a simple structure can be easily assembled.

Since the reinforcing member 101 is mounted on the side plate 24 after the front glass panel 39 has been fitted, there is no need for providing the side plate 24 itself with a high rigidity, whereby the fitting mounting of the front glass panel 39 can be much facilitated.

Further, it should be noted that in the embodiment of the invention, the tip end portion 101*a* of the reinforcing member 101, which is substantially impermeable to the cooling air, is positioned in the vicinity of the rounded corner 110 of the front glass panel 39. This is advantageous in that the coolant flow within the passage 28 is divided into two streams, whereby not only the temperature distribution is improved but also protection can be assured for the rounded portion 110 of the front glass panel 39 which is more likely to be susceptible to the influence of thermal stress.

Next, description will be directed to a modified embodiment of the refrigeration apparatus according to the invention by reference to FIGS. 9, 10 and 11A to 11C. In the description of the modified embodiment, the description of the parts which are the same or equivalent to those of the preceding embodiment is omitted. In the modified embodiment, the upper end portion of the front glass panel 39 is supported on the ceiling plate 36 with the aid of a spacer 81 and a guide 80 disposed longitudinally with a distance therebetween, the guide 80 having a lower surface formed with a multiplicity of openings.

A top frame 35 for supporting the upper end portion of the outer front glass panel 38 fitted with the packing 37*b* is connected to the top cover 34 and to the ceiling plate 36 through a fixing member 42, whereby a ceiling coolant passage (cooling air circulating passage) 29 is defined in cooperation with the ceiling plate 36, the spacer 81 and a seal member 83 having an inverted C-like section and a thickness equal to that of the spacer 81. The ceiling coolant passage 29 thus formed is communicated with a display chamber or space 65 through vent holes 85*a* and 85*b*.

Figure 10:
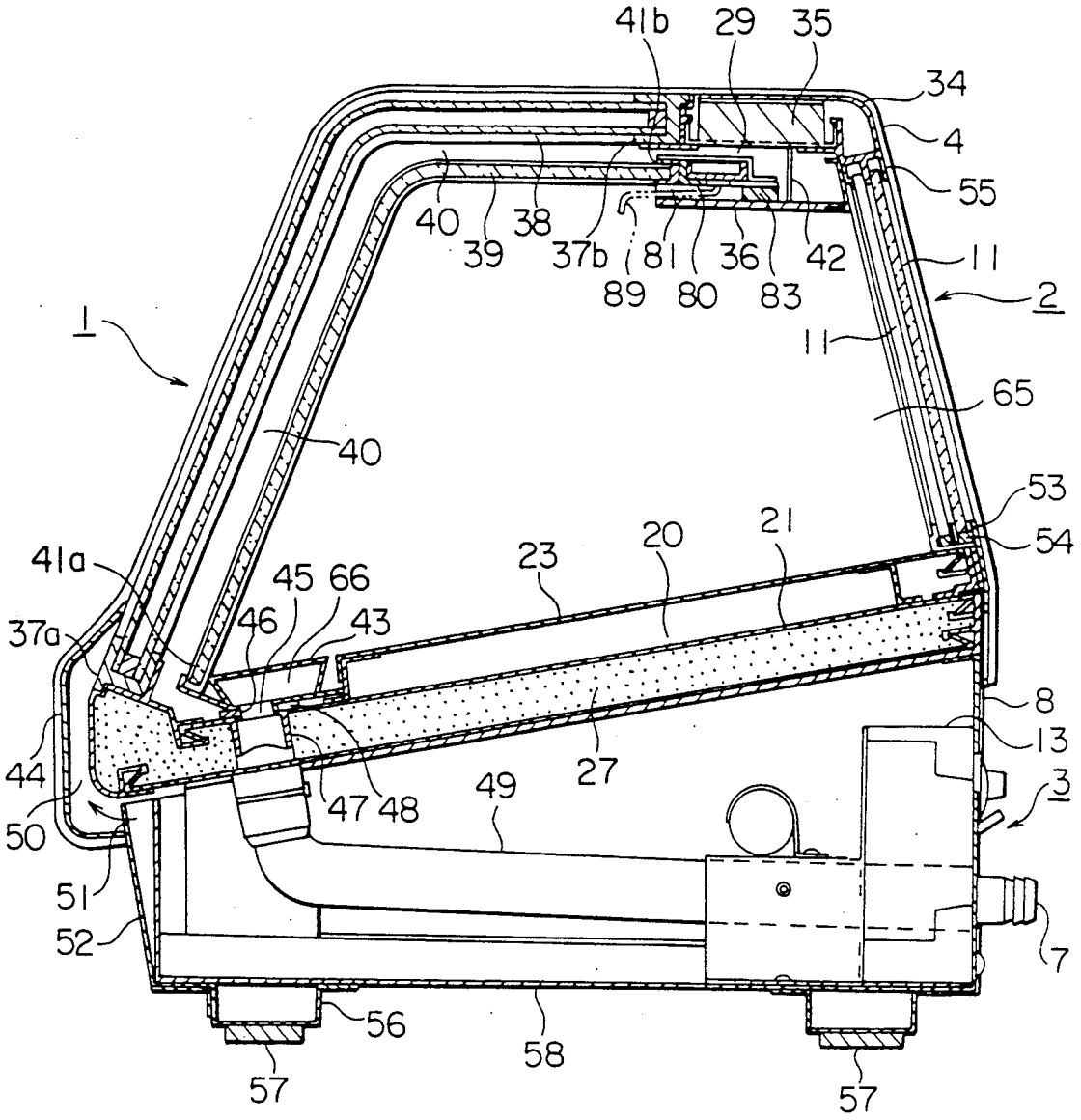
FIG. 10 is a sectional view taken along the line X—X in FIG. 9.
Figure 11A:
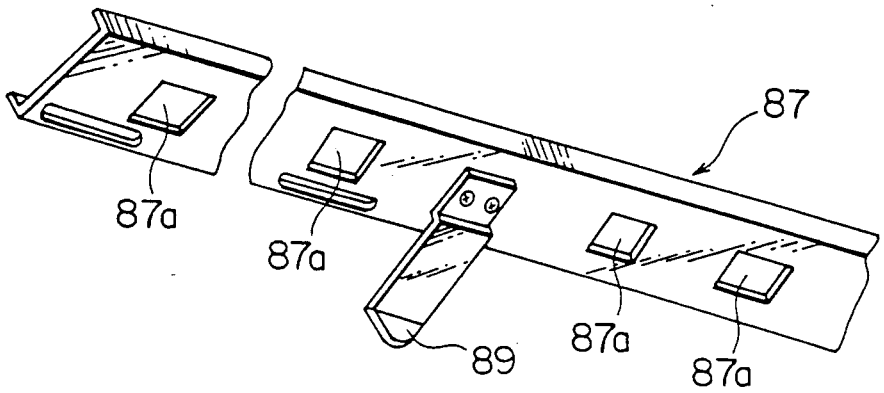
FIGS. 11A to 11C are perspective views showing, respectively, individual members of a coolant discharge amount regulating device installed within a coolant circulating passage in the refrigeration apparatus shown in FIG. 9.
Figure 11B:
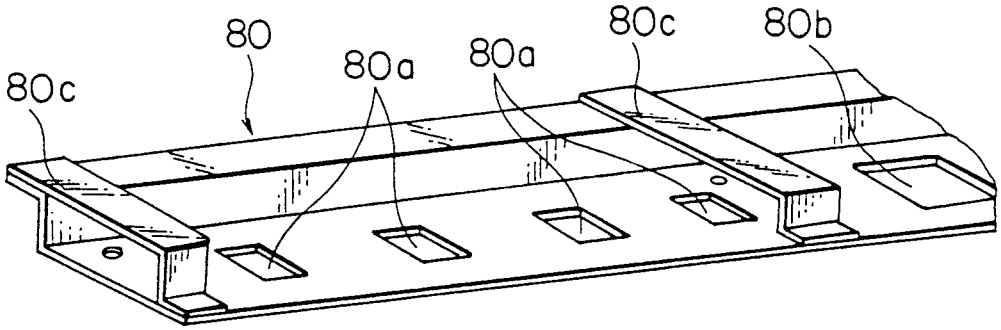
Figure 11C:
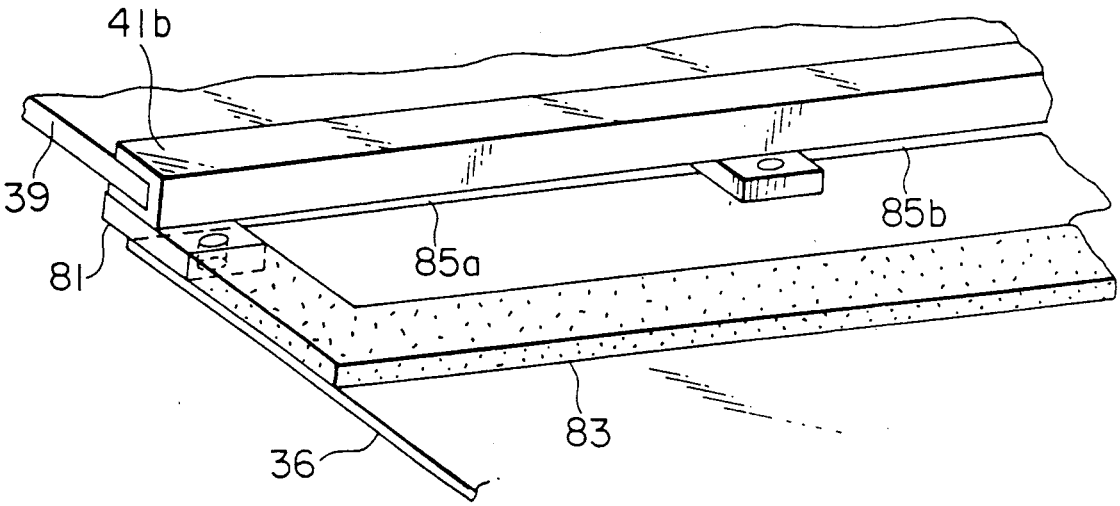

As clearly shown in FIGS. 10 and 11A to 11C, the guide frame member or guide 80 having a plurality of rectangular openings 80*a* formed therein is disposed within the ceiling coolant passage 29 of the seal member 83 having the same thickness as the spacer 81 and is secured to the ceiling plate 36 together with the spacer 81. Referring to FIG. 11B showing the guide 80 in more detail, a rectangular opening 80*b* having a slightly greater size is formed in the guide 80 at a center portion, and a stiffener 80*c* is fixedly secured which also serves as a guide member for the slider 87. The slider 87 is formed with rectangular openings 87*a* of a size corresponding to that of the rectangular openings 80*a* formed in the guide 80 with a same distance as that of the latter, wherein an adjusting lever 89 is secured by screws at a location on the slider 87 corresponding to the rectangular opening 80*b* after the slider 87 having been mounted on the guide 80 (refer to FIG. 11A). The guide 80, the slider 87 and the lever 89 shown in FIGS. 11A and 11B are so assembled together as to constitute a discharged cooling air flow adjusting apparatus. In the assembled state, the lever 89 extends through the rectangular opening 80*b* and the vent hole 85*a* to project into the display space 65. In FIG. 10, the lever 89 is partially illustrated by a phantom line (double-dotted broken line).

Turning back to FIG. 9, there are disposed downstream of the ceiling coolant passage 29 a flow intercepting member 97 which is movable together with the slider 87 and a stationary flow intercepting member 99 for closing the other portion of the ceiling coolant passage 29.

In the modified embodiment, the cooling air entering the coolant passage 29 flows in such a manner as described below. When the position of the lever 89 is so adjusted that the openings 80*a* formed in the guide member 80 are positioned in fully coincidence with the openings 87*a* formed in the slider 87 (this state will be referred to as the full opened state), the cooling air flows through the openings 80*a* and 87*a* upstream of the flow intercepting members 97 and 99 and the vent hole 85*a* along the inner surface of the front glass panel 39 into the display space 65.

The cooling air then flows along the inner surface of the front glass panel 39 and through the vent holes 85*a* and 84*b* as well as the openings 80*a* and 87*a* located downstream of the flow intercepting members 97 and 99 back to the coolant passage 29 and hence to the passage 28 to merge with the other cooling air stream to enter again the cooler chamber 12 through the return passage 71.

On the other hand, when the openings 80*a* and 87*a* are fully or wholly offset from each other (i.e. in the fully closed state), the cooling air is inhibited from flowing to the vent hole 85*a*. In this conjunction, it should be noted that the cooling air passages 29 and 40 are communicated with each other through a larger or smaller gap for allowing the cooling air to flow sufficiently, as illustrated in FIG. 10, notwithstanding of the provision of the flow intercepting members 97 and 99.

The adjustment of the flow sectional area of the openings 80*a* between the fully opened and closed states can be effectuated steplessly or continuously by manipulating the lever 89 internally of the display space 65. By appropriately selecting the widths of the lever 89 and the openings 80*b* of the guide 80, the fully opened and closed positions can be definitely determined, wherein the position of the lever 89 can be adjusted between these positions as needed.

According to the modified embodiment described above, the adjusting lever of the discharged cooling air flow adjusting or regulating device extends from the vent hole formed in the ceiling cooling air passage into the interior of the inner box, and the stroke of the adjusting or regulating lever is limited by the opening formed in the guide. Thus, the associated structure of the display chamber can be simplified without need for the provision of any special seal member.

Figure 12:
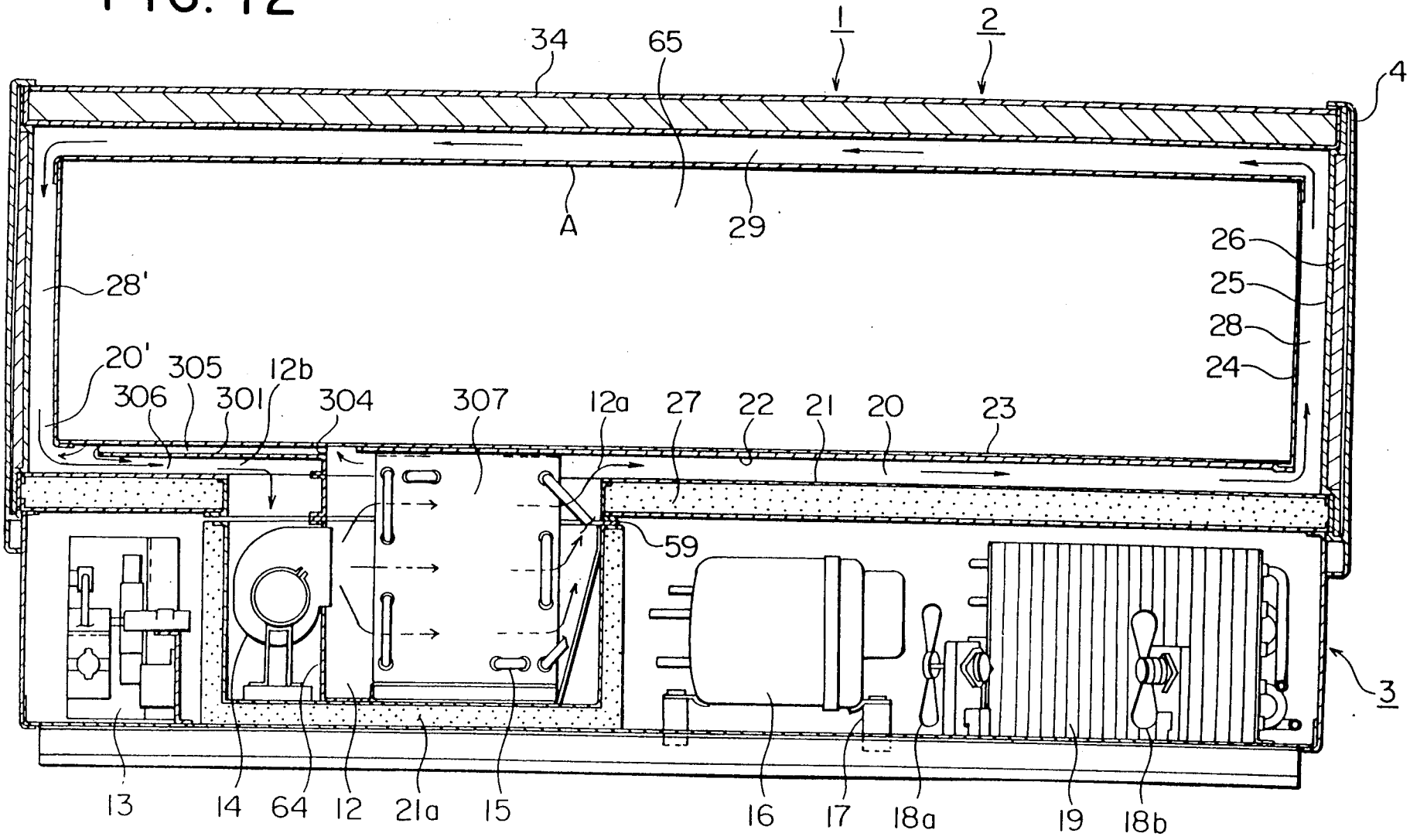
FIGS. 12 and 13 are sectional views similar to FIG. 3 and show, respectively, further modified embodiments of the refrigeration apparatus according to the invention.
Figure 13:
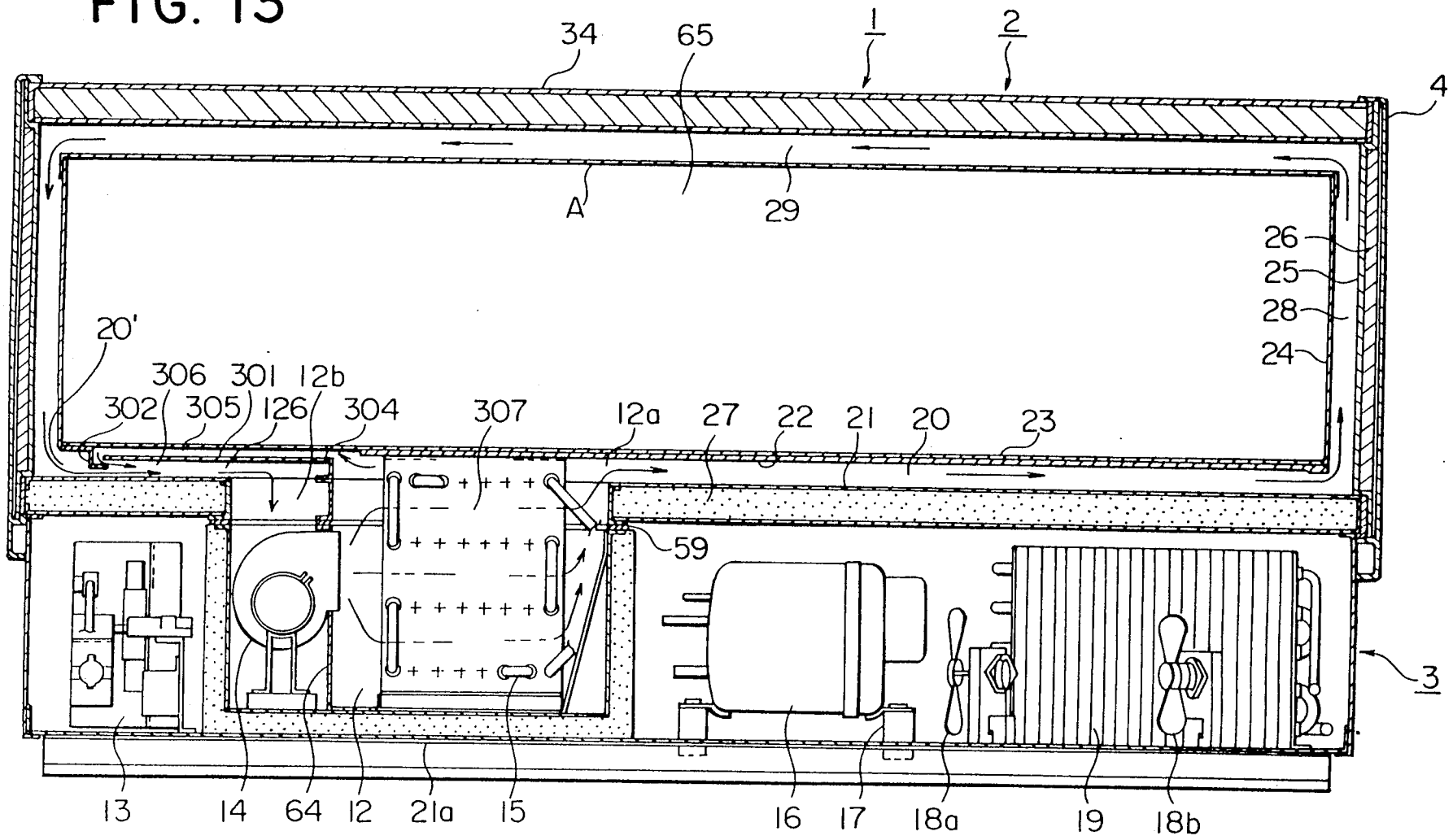

FIGS. 12 and 13 show a further modified structure of the coolant circulating passage. The following description is directed only to the parts which differ from those of the preceding embodiments. Referring to FIG. 12, a partition plate 301 is provided beneath the bottom plate 23 of the inner box A defining a passage 20' constituting the return passage of the coolant circulating passage system, which partition plate 301 partitions the passage 20' into two subpassages present on the sides of the inner and outer boxes, respectively. An end of an auxiliary coolant circulating subpassage 305 defined between the partition plate 301 and the inner box is communicated with an upper opening 304 formed in a partition plate 64 defining a part of the cooler chamber 12, while the other end is merged to the return passage 20' as in the prior art refrigeration apparatus to thereby constitute a subpassage 306. A reference numeral 307 denotes side plates of the cooler chamber 12 (reference may also be made to FIG. 4).

With the structure described above, the air substantially consumed the cooling capability is forced to flow through the subpassage 306 defined on the outer box side which is out of contact with the inner box A, while the fresh cooling air is allowed to flow through the subpassage 305 (defined on the inner box side) which is communicated with the upper opening 304 in the partition plate 64 of the cooler chamber 12 to thereby cool very uniformly the display chamber 2.

In place of joining the auxiliary coolant circulating subpassage 305 at the other end thereof to the passage 20', it is also possible to lead it to the suction opening 12*b*. Further, fresh cooling air may be introduced to the auxiliary coolant circulating subpassage 305 at the other end through a pipe in such manner that the cooling air can flow in parallel with the cooling air flowing through the return passage with the partition pate 301 being interposed between both coolant flows. Also, an opening may be formed in the patition plate formed integrally with a hood 302 (FIG. 13).

In the modified embodiment now under consideration, a plurality of air directing plates, which are similar to those 32 shown in FIG. 4, are hermetically mounted between the vicinity of the outlet of the cooling air circulating fan 14 and the end plate 307 of the cooler 15 so that all the air discharged from the coolant circulating fan 14 can be conducted to the fins of the cooler 15, although not shown in FIG. 12. Further, as will be appreciated from FIG. 4, there is provided a considerable distance between each end plate 307 and the associated side wall of the heat insulating structure 21, whereby a passage 303 (refer to FIG. 4) is formed therebetween, although not shown in FIG. 12. By the provision of these passages 303 in addition to the subpassage 305 formed on the inner box side as described hereinbefore, a part of the cooling air leaving the cooler 15 can preferably flow in the reverse direction.

In the modified embodiment shown in FIG. 13, a hood 302 is provided in front of the subpassage 305. By providing the hood 302 in this manner, the cooling air leaving the subpassage 305 is prevented from flowing in opposition to the air flowing downwardly through the return passage 20' and having consumed substantially the cooling capability. It should be added in conjunction with the instant embodiment that there are provided a plurality of air directing plates 32, the passages 303 and others as in the case of the embodiment shown in FIG. 12.

It is thought that the present invention will be understood from the foregoing description and it will be apparent that various changes may be made in the form, construction and arrangement thereof without departing from the spirit and scope of the invention or sacrificing all of its material advantages, the forms hereinbefore described being merely preferred or exemplary embodiments thereof.

What is claimed is:

1. A refrigeration apparatus comprising:

a machine chamber accommodating therein at least a compressor and a condenser;

a display chamber for accommodating therein articles to be displayed, said display chamber being constituted by an inner box, and an outer box;

coolant passage means defined between said inner and outer boxes;

a cooler chamber defined within said machine chamber and substantially enclosed by a heat insulating material so as to be in communication only with said coolant passage means, said cooler chamber containing therein a cooler and cooling air circulating means for cooling air in said cooler chamber and circulating the cooled air only through said coolant passage means and back to said cooler chamber without flow communication through said display chamber; and wherein a partitioning plate provided at a portion of a return passage for said cooling air passage means divides said return passage into a subpassage on the side of said outer box and an auxiliary coolant circulating passage on the side of said inner box.

2. A refrigeration apparatus, comprising:

a machine chamber accommodating therein at least a compressor and a condenser;

a display chamber having a top wall, a bottom wall, a transparent front wall for viewing therethrough, a back wall, and respective side walls for enclosing and accommodating therein articles to be displayed, said display chamber being constituted by an inner box, and an outer box substantially surrounding said inner box;

said inner and outer boxes being spaced apart at least substantially throughout the areas of said top wall, bottom wall, front wall, and respective end walls of said display chamber to define respective and interconnected coolant air passages therebetween; and a cooler chamber defined within said machine chamber and substantially enclosed by a heat insulating material so as to be in communication only with said coolant air passages, said cooler chamber containing therein a cooler and cooling air circulating means for cooling air in said cooler chamber and circulating the cooled air only through said coolant air passages and back to said cooler chamber without flow communication through said display chamber.

3. A refrigeration apparatus, comprising:

a lower box-like machine chamber accommodating therein at least a compressor and a condenser;

an upper box-like display chamber for accommodating articles to be displayed, said display chamber including an inner box constituted by a bottom plate defining a bottom of said inner box, a pair of upwardly extending side plates connected at lower ends thereof to said bottom plate, a ceiling plate connected to said pair of side plates at upper ends thereof, and an inner front transparent panel which has an upper end supported by said ceiling plate, a lower end supported by said bottom plate, and lateral ends engaging with said pair of side plates, respectively; and an outer box constituted by a heat insulating structure defining a bottom of said outer box cofacing and spaced from said bottom of the inner box, a pair of upwardly extending side plates respectively connected at lower ends thereof to said heat insulating structure in cofacing spaced apart relation to said inner box side plates, a top plate connected to said pair of side plates at upper ends thereof in cofacing spaced apart relation to said inner box ceiling plate, and an outer front transparent panel which has an upper end supported by said top plate, a lower end supported by said heat insulating structure, and lateral ends engaging with said pair of side plates, respectively, said inner and outer front transparent panels being in cofacing spaced apart relation with each other for viewing the contents of said display chamber;

said spacings between said top plates, front panels, side plates, and bottoms defining interconnected cooling air passages between said inner and outer boxes;

a cooler chamber located within the bottom of said outer box toward the interior of said machine chamber, said cooler chamber communicating with said cooling air passages and containing therein a cooler and cooling air circulating means for cooling air in said cooler chamber and circulating the cooled air only through said cooling air passages and back to said cooler chamber without flow communication through said display chamber.

4. A refrigeration apparatus as set forth in claim 2, said display chamber (2) being disposed above said machine chamber (3) and extending substantially along the whole length in the direction lengthwise of said refrigeration apparatus, wherein said machine chamber (3) has a ceiling wall (21) extending with an inclination upwardly from a front cover (52) of said machine chamber (3) to a rear cover (8) thereof to thereby defining a sufficient space for accommodating therein at least said compressor (16) and said condenser (19).

5. A refrigeration apparatus as set forth in claim 4, further including a heat conduction suppressing member (22) provided in association with said bottom plate (23) of said inner box.

6. A refrigeration apparatus, comprising:

a lower box-like machine chamber accommodating therein at least a compressor and a condenser;

an upper box-like display chamber for accommodating articles to be displayed, said display chamber including an inner box constituted by a bottom plate defining a bottom of said inner box, a pair of upwardly extending side plates connected at lower ends thereof to said bottom plate, a ceiling plate connected to said pair of side plates at upper ends thereof, and an inner front glass panel which has an upper end supported by said ceiling plate, a lower end supported by said bottom plate and lateral ends engaging with said pair of side plates, respectively, and an outer box constituted by a heat insulating structure defining a bottom of said outer box, a pair of upwardly extending side frames connected at lower ends thereof to said heat insulating structure, a top frame connected to said pair of the side frames at upper ends thereof and an outer front glass panel which has an upper end supported by said top frame, a lower end supported by said heat insulating structure and lateral ends engaging with said pair of the side frames, respectively;

cooling air passage means defined between said inner and outer boxes by disposing said outer box externally of said inner box so as to enclose the latter with a distance therefrom; and a cooler chamber defined by depressing concavely a part of said heat insulating structure located at the bottom of said outer box toward the interior of said machine chamber, said cooler chamber being communicated with said cooling air passage means and containing therein cooling air circulating means and a cooler, whereby the cooling air in said cooler chamber is caused to circulate through said cooling air passage means and back to said cooler chamber, one of said side plates having an external surface provided with an elongated reinforcing member.

7. A refrigeration apparatus as set forth in claim 6, wherein said reinforcing member (101) has a generally inverted C-like section with an opening and mounted on the external surface of said side plate (24) with said opening facing said external surface by means of a mounting plate (102) having a generally inverted C-like section and an opening which faces toward said external surface of said side plate (24).

8. A refrigeration apparatus as set forth in claim 7, wherein said reinforcing member (101) and said mounting plate (102) are so disposed that upper ends of said plates (101, 102) are directed toward a rounded corner portion (110) of said inner front glass panel (39), and wherein said mounting plate (102) has a height ($H_1$) while said reinforcing member (101) has a height ($H_2$) greater than that ($H_1$) of said mounting plate (102).

9. A refrigeration apparatus, comprising:

a machine chamber accommodating therein at least a compressor and a condenser;

a display chamber for accommodating therein articles to be displayed, said display chamber being constituted by an inner box, and an outer box;

coolant passage means defined between said inner and outer boxes; and a cooler chamber defined within said machine chamber and substantially enclosed by a heat insulating material so as to be in communication only with said coolant passage means, said cooler chamber containing therein cooling air circulating means and a cooler, whereby the cooling air in said cooler chamber is caused to circulate through said coolant passage means and back to said cooler chamber, said cooling air discharge amount regulating means being disposed within a ceiling cooling air passage constituting a part of said coolant passage means and defined above said inner box, and wherein a cooling air discharge amount adjusting lever of said cooling air discharge amount regulating means extends outwardly through cooling air discharge vent holes formed in said ceiling cooling air passage.

10. A refrigeration apparatus as set forth in claim 9, wherein said cooling air discharge amount regulating means includes a guide plate (80) fixedly secured so as to cover substantially the bottom surface of said ceiling air coolant passage (29) and having a plurality of openings (80*a*) formed therethrough and spaced from one another, and a slide plate (87) slideably mounted on said guide plate (80) and having a plurality of openings (87*a*) formed therethrough and spaced from one another such that said openings (80*a*) of said guide plate (80) can be selectively closed.

11. A refrigeration apparatus, comprising:

a machine chamber accommodating therein at least a compressor and a condenser;

a display chamber for accommodating therein articles to be displayed, said display chamber being constituted by an inner box, and an outer box;

coolant passage means defined between said inner and outer boxes;

a cooler chamber defined within said machine chamber and substantially enclosed by a heat insulating material so as to be in communication only with said coolant passage means, said cooler chamber containing therein cooling air circulating means and a cooler, whereby the cooling air in said cooler chamber is caused to circulate through said coolant passage means and back to said cooler chamber; and a partitioning plate provided at a portion of a return passage for said cooling air passage means dividing said return passage into a subpassage on the side of said outer box and an auxiliary coolant circulating passage on the side of said inner box, said cooling air circulating means comprising a cooling air circulating fan, said cooler being provided with fins and having end plates at both sides, respectively, further including:

a plurality of guide plates provided between said cooling air circulating fan and said cooler for guiding substantially all the air blown out from said cooling air circulating fan between the inner surfaces of said end plates of said cooler;

a passage defined between the outer surface of each of said end plates and the associated inner surface of said cooler chamber; and wherein at least a part of the air having passed through said cooler is caused to flow toward said auxiliary coolant circulating passage along the outer surface of said end plates.

12. A refrigeration apparatus as set forth in claim 11, wherein said portion (20') of the return passage is provided with a hood (302) on the side to the exit opening of said auxiliary coolant circulating passage (305) spaced with a distance from said exit opening.

13. A refrigeration apparatus, comprising:

a lower box-like machine chamber accommodating therein at least a compressor and a condenser;

an upper box-like display chamber for accommodating articles to be displayed, said display chamber including an inner box constituted by a bottom plate defining a bottom of said inner box, a pair of upwardly extending side plates connected at lower ends thereof to said bottom plate, a ceiling plate connected to said pair of side plates at upper ends thereof, and an inner front glass panel which has an upper end supported by said ceiling plate, a lower end supported by said bottom plate and lateral ends engaging with said pair of side plates, respectively, and an outer box constituted by a heat insulating structure defining a bottom of said outer box, a pair of upwardly extending side frames connected at lower ends thereof to said heat insulating structure, a top frame connected to said pair of the side frames at upper ends thereof and an outer front glass panel which has an upper end supported by said top frame, a lower end supported by said heat insulating structure and lateral ends engaging with said pair of the side frames, respectively;

cooling air passage means defined between said inner and outer boxes by disposing said outer box externally of said dinner box so as to enclose the latter with a distance therefrom; and a cooler chamber defined by depressing concavely a part of said heat insulating structure located at the bottom of said outer box toward the interior of said machine chamber, said cooler chamber being communicated with said cooling air passage means and containing therein cooling air circulating means and a cooler, whereby the cooling air in said cooler chamber is caused to circulate through said cooling air passage means and back to said cooler chamber; and a ceiling cooling air passage constituting a part of said cooling air passage means and defined adjacent and along upper end portions of said inner front glass panel and said outer front glass panel has formed therein vent holes opening in the inner surfaces of said inner front glass panel and said outer front glass panel at positions adjacent to the upper end portions thereof.

14. A refrigeration apparatus as set forth in claim 13, wherein cooling air discharge amount regulating means (80, 87, 89) is disposed within said ceiling cooling air passage (29).

15. A refrigeration apparatus as set forth in claim 14, said cooling air discharge amount regulating means including a guide frame (80), whereby the upper end portion of said inner front glass panel (89) is supported.

16. A refrigeration apparatus as set forth in claim 13, wherein flow intercepting members (97, 99) are provided within said ceiling cooling air passage (29).

17. A refrigeration apparatus, comprising:

a lower box-like machine chamber accommodating therein at least a compressor and a condenser;

an upper box-like display chamber for accommodating articles to be displayed, said display chamber including an inner box constituted by a bottom plate defining a bottom of said inner box, a pair of upwardly extending side plates connected at lower ends thereof to said bottom plate, a ceiling plate connected to said pair of side plates at upper ends thereof, and an inner front glass panel which has an upper end supported by said ceiling plate, a lower end supported by said bottom plate and lateral ends engaging with said pair of side plates, respectively, and an outer box constituted by a heat insulating structure defining a bottom of said outer box, a pair of upwardly extending side frames connected at lower ends thereof to said heat insulating structure, a top frame connected to said pair of the side frames at upper ends thereof and an outer front glass panel which has an upper end supported by said top frame, a lower end supported by said heat insulating structure and lateral ends engaging with said pair of the side frames, respectively;

cooling air passage means defined between said inner and outer boxes by disposing said outer box externally of said inner box so as to enclose the latter with a distance therefrom; and a cooler chamber defined by depressing concavely a part of said heat insulating structure located at the bottom of said outer box toward the interior of said machine chamber, said cooler chamber being communicated with said cooling air passage means and containing therein cooling air circulating means and a cooler, whereby the cooling air in said cooler chamber is caused to circulate through said cooling air passage means and back to said cooler chamber, said bottom plate extending with an inclination downwardly from the rear side to the front side, wherein a recessed groove extends lengthwise of said refrigeration apparatus in an intermediate portion of said bottom plate, said groove being formed with at least one drain opening communicated to the exterior of said refrigeration apparatus.

18. A refrigeration apparatus, comprising:

a lower box-like machine chamber accommodating therein at least a compressor and a condenser;

an upper box-like display chamber for accommodating articles to be displayed, said display chamber including an inner box constituted by a bottom plate defining a bottom of said inner box, a pair of upwardly extending side plates connected at lower ends thereof to said bottom plate, a ceiling plate connected to said pair of side plates at upper ends thereof, and an inner front glass panel which has an upper end supported by said ceiling plate, a lower end supported by said bottom plate and lateral ends engaging with said pair of side plates, respectively, and an outer box constituted by a heat insulating structure defining a bottom of said outer box, a pair of upwardly extending side frames connected at lower ends thereof to said heat insulating structure, a top frame connected to said pair of the side frames at upper ends thereof and an outer front glass panel which has an upper end supported by said top frame, a lower end supported by said heat insulating structure and lateral ends engaging with said pair of the side frames, respectively;

cooling air passage means defined between said inner and outer boxes by disposing said outer box externally of said inner box so as to enclose the latter with a distance therefrom; and a cooler chamber defined by depressing concavely a part of said heat insulating structure located at the bottom of said outer box toward the interior of said machine chamber, said cooler chamber being communicated with said cooling air passage means and containing therein cooling air circulating means and a cooler, whereby the cooling air in said cooler chamber is caused to circulate through said cooling air passage means and back to said cooler chamber, an end portion of said bottom plate located at the side of said inner front glass being decreased in height as compared with the other portion of said bottom plate to thereby form a recessed groove, wherein the lower end portion of said inner front glass panel is supported within said groove.

19. A refrigeration apparatus, comprising:

a lower box-like machine chamber accommodating therein at least a compressor and a condenser;

an upper box-like display chamber for accommodating articles to be displayed, said display chamber including an inner box constituted by a bottom plate defining a bottom of said inner box, a pair of upwardly extending side plates connected at lower ends thereof to said bottom plate, a ceiling plate connected to said pair of side plates at upper ends thereof, and an inner front glass panel which has an upper end supported by said ceiling plate, a lower end supported by said bottom plate and lateral ends engaging with said pair of side plates, respectively, and an outer box constituted by a heat insulating structure defining a bottom of said outer box, a pair of upwardly extending side frames connected at lower ends thereof to said heat insulating structure, a top frame connected to said pair of the side frames at upper ends thereof and an outer front glass panel which has an upper end supported by said top frame, a lower end supported by said heat insulating structure and lateral ends engaging with said pair of the side frames, respectively;

cooling air passage means defined between said inner and outer boxes by disposing said outer box externally of said inner box so as to enclose the latter with a distance therefrom; and a cooler chamber defined by depressing concavely a part of said heat insulating structure located at the bottom of said outer box toward the interior of said machine chamber, said cooler chamber being communicated with said cooling air passage means and containing therein cooling air circulating means and a cooler, whereby the cooling air in said cooler chamber is caused to circulate through said cooling air passage means and back to said cooler chamber, said display chamber including platforms which are inclined downwardly toward the lower end portions of said inner front glass panel and said outer front glass panel.

20. A refrigeration apparatus, comprising:

a lower box-like machine chamber accommodating therein at least a compressor and a condenser;

an upper box-like display chamber for accommodating articles to be displayed, said display chamber including an inner box constituted by a bottom plate defining a bottom of said inner box, a pair of upwardly extending side plates connected at lower ends thereof said bottom plate, a ceiling plate connected to said pair of side plates at upper ends thereof, and an inner front glass panel which has an upper end supported by said ceiling plate, a lower end supported by said bottom plate and lateral ends engaging with said pair of side plates, respectively, and an outer box constituted by a heat insulating structure defining a bottom of said outer box, a pair of upwardly extending side frames connected at lower ends thereof to said heat insulating structure, a top frame connected to said pair of the side frames at upper ends thereof and an outer front glass panel which has an upper end supported by said top frame, a lower end supported by said heat insulating structure and lateral ends engaging with said pair of the side frames, respectively;

cooling air passage means defined between said inner and outer boxes by disposing said outer box externally of said inner box so as to enclose the latter with a distance therefrom; and a cooler chamber defined by depressing concavely a part of said heat insulating structure located at the bottom of said outer box toward the interior of said machine chamber, said cooler chamber being communicated with said cooling air passage means and containing therein cooling air circulating means and a cooler, whereby the cooling air in said cooler chamber is caused to circulate through said cooling air passage means and back to said cooler chamber, said machine chamber being provided with a hot air discharge port for discharging anti-clouding hot air and includes at least two condenser fans installed in a passage for air flowing in contact with an external surface of said condenser so that the air discharging direction of one of said condenser fans is directed toward said compressor, while that of the other condenser fan is directed toward said discharge port provided along the outer surface of said outer front glass panel.

21. A refrigeration apparatus as set forth in claim 20, wherein the passage for the air flowing in contact with the external surface of said condenser (19) is partitioned by a duct forming plate (33) having a generally W-like section into one passage portion directed toward said compressor (16) and the other passage portion directed toward said anti-clouding hot air discharge port (51), said one condenser fan (18*a*) being disposed within said one passage portion while said other condenser fan (18*b*) is disposed within said other passage portion.

* * * * *

UNITED STATES PATENT AND TRADEMARK OFFICE

CERTIFICATE OF CORRECTION

PATENT NO. : 5,046,328

DATED : September 10, 1991

INVENTOR(S) : Akiyoshi Yoshida et al.

It is certified that error appears in the above-identified patent and that said Letters Patent is hereby corrected as shown below:

Col. 3, lines 66 and 67, "A-A" should read --IIA-IIA--; "B-B" should read --IIB-IIB--.

Col. 5, line 9, "material" should read --material,--.

Col. 5, line 33, "28" should read --28,--.

Col. 7, line 52, after the word "posture" and before the word "easily" insert the word --can--.

Col. 11, line 38, "fully" should read --full--.

Col. 12, line 46, after the word "such" and before the word "manner" insert the word --a--.

Col. 19, line 47, after the word "thereof" and before the word "said" insert the word --to--.

Signed and Sealed this

Sixth Day of April, 1993

*Attest:*

STEPHEN G. KUNIN

*Attesting Officer*

*Acting Commissioner of Patents and Trademarks*